US007283113B2

(12) United States Patent
Ham

(10) Patent No.: US 7,283,113 B2
(45) Date of Patent: Oct. 16, 2007

(54) METHOD AND APPARATUS FOR DRIVING LIQUID CRYSTAL DISPLAY

(75) Inventor: Yong Sung Ham, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 145 days.

(21) Appl. No.: 09/993,563

(22) Filed: Nov. 27, 2001

(65) Prior Publication Data

US 2003/0095089 A1 May 22, 2003

(30) Foreign Application Priority Data

Sep. 4, 2001 (KR) ..... 2001-54124

(51) Int. Cl.
*G09G 3/36* (2006.01)
*G09G 5/02* (2006.01)
*G09G 5/10* (2006.01)

(52) U.S. Cl. ..... 345/87; 345/89; 345/600; 345/601; 345/602; 345/605; 345/690; 345/692

(58) Field of Classification Search ..... 345/87–104
See application file for complete search history.

(56) References Cited

U.S. PATENT DOCUMENTS 5,123,059 A * 6/1992 Hirosawa et al. ..... 382/272
5,495,265 A 2/1996 Hartman et al.
6,943,763 B2 * 9/2005 Shibata et al. ..... 345/89
2001/0038372 A1 * 11/2001 Lee ..... 345/89
2001/0043178 A1 * 11/2001 Okuzono et al. ..... 345/87

FOREIGN PATENT DOCUMENTS

WO WO99/05567 2/1999

* cited by examiner

*Primary Examiner*—Sumati Lefkowitz
*Assistant Examiner*—Alexander S. Beck
(74) *Attorney, Agent, or Firm*—McKenna Long & Aldridge LLP

(57) ABSTRACT

A method and apparatus of driving a liquid crystal display device that is adaptive for preventing a deterioration of picture quality. More specifically, a method of driving a liquid crystal display includes dividing input data into most significant bit data and least significant bit data, delaying the most significant bit data for one frame period, and modulating the most significant bit data in accordance with a difference between the delayed most significant bit data and the current most significant bit data, wherein the modulated data have a data width not wider than that of the input data and not narrower than that of the most significant bit data.

15 Claims, 6 Drawing Sheets

METHOD AND APPARATUS FOR DRIVING LIQUID CRYSTAL DISPLAY

This application claims the benefit of Korean Application No. P2001-54124 filed on Sep. 4, 2001, which is hereby incorporated by reference.

BACKGROUND OF THE INVENTION

1. Field of the Invention

The present invention relates to a liquid crystal display, and more particularly, to a method and apparatus for driving a liquid crystal display. Although the present invention is suitable for a wide scope of applications, it is particularly suitable for preventing a deterioration of picture quality.

2. Discussion of the Related Art

Generally, a liquid crystal display (LCD) controls a light transmittance of each liquid crystal cell in accordance with a video signal, thereby displaying a picture. An active matrix LCD including a switching device for each liquid crystal cell is suitable for displaying a moving picture. The active matrix LCD uses a thin film transistor (TFT) as a switching device.

The LCD has a disadvantage in that it has a slow response time due to inherent characteristics of a liquid crystal, such as a viscosity and an elasticity, etc. Such characteristics can be explained by using the following equations (1) and (2):

$$\tau_r \propto \gamma d^2/\Delta\in|V_a^2-V_F^2| \quad (1)$$

where $\tau_r$ represents a rising time when a voltage is applied to a liquid crystal; $\Delta\in$ is a dielectric anisotropy; $V_a$ is an applied voltage; $V_F$ represents a Freederick transition voltage at which liquid crystal molecules begin to perform a tilt motion; d is a cell gap of liquid crystal cells; and $\gamma$ is a rotational viscosity of the liquid crystal molecules.

$$\tau_f \propto \gamma d^2/K \quad (2)$$

wherein $\tau_f$ represents a falling time at which a liquid crystal is returned into the initial position by an elastic restoring force after a voltage applied to the liquid crystal was turned off, and K is an elastic constant.

A twisted nematic (TN) mode liquid crystal has a different response time due to physical characteristics of the liquid crystal and a cell gap, etc. Typically, the TN mode liquid crystal has a rising time of 20 to 80 ms and a falling time of 20 to 30 ms. Since such a liquid crystal has a response time longer than one frame interval (i.e., 16.67 ms in the case of NTSC system) of a moving picture, a moving picture is displayed with a brightness lower than the corresponding value of video data VD as in FIG. 1.

Referring to FIG. 1, the conventional LCD cannot express a desired color and brightness. Upon implementation of a moving picture, a display brightness BL fails to arrive at a target brightness corresponding to a change of the video data VD from one level to another level due to its slow response time. Accordingly, a motion-blurring phenomenon appears from the moving picture and a display quality is deteriorated in the LCD due to a reduction in a contrast ratio.

In order to overcome such a slow response time of the LCD, U.S. Pat. No. 5,495,265 and PCT International Publication No. WO99/05567 have suggested to modulate data in accordance with a difference in the data by using a look-up table (hereinafter referred to as high-speed driving method). This high-speed driving method allows data to be modulated by a principle as shown in FIG. 2.

Referring to FIG. 2, a conventional high-speed driving method modulates input data VD and applies the modulated data MVD to the liquid crystal cell, thereby obtaining a desired brightness MBL. This high-speed driving method modulates $|V_a^2-V_F^2|$ from the above equation (1) on the basis of a differene of the data so that a desired brightness can be obtained in response to a brightness value of the input data within one frame interval, thereby rapidly reducing a response time of the liquid crystal. Accordingly, the LCD employing such a high-speed driving method compensates for a slow response time of the liquid crystal by modulating a data value in order to alleviate a motion-blurring phenomenon in a moving picture, thereby displaying a picture at desired color and brightness.

In other words, the high-speed driving method compares most significant bit data MSB of the previous frame Fn−1 and the current frame Fn, respectively. If there is any difference between the most significant bit data MSB, it selects a modulated data and modulates as in FIG. 3.

When the most significant bit data MSB is limited to 4 bits, a look-up table in the high-speed driving method is implemented by the following tables:

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 3 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 14 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 13 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

TABLE 2

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 0 | 0 | 32 | 48 | 64 | 80 | 96 | 112 | 144 | 160 | 192 | 208 | 224 | 240 | 240 | 240 | 240 |
| 16 | 0 | 16 | 48 | 64 | 80 | 96 | 112 | 128 | 160 | 192 | 208 | 224 | 240 | 240 | 240 | 240 |
| 32 | 0 | 0 | 32 | 64 | 80 | 96 | 112 | 128 | 160 | 192 | 208 | 224 | 240 | 240 | 240 | 240 |
| 48 | 0 | 0 | 16 | 48 | 80 | 96 | 112 | 128 | 160 | 176 | 208 | 224 | 240 | 240 | 240 | 240 |
| 64 | 0 | 0 | 16 | 48 | 64 | 96 | 112 | 128 | 144 | 176 | 192 | 208 | 224 | 240 | 240 | 240 |
| 80 | 0 | 0 | 16 | 32 | 48 | 80 | 112 | 128 | 144 | 176 | 192 | 208 | 224 | 240 | 240 | 240 |
| 96 | 0 | 0 | 16 | 32 | 48 | 64 | 96 | 128 | 144 | 160 | 192 | 208 | 224 | 240 | 240 | 240 |
| 112 | 0 | 0 | 16 | 32 | 48 | 64 | 80 | 112 | 144 | 160 | 176 | 208 | 224 | 240 | 240 | 240 |
| 128 | 0 | 0 | 16 | 32 | 48 | 64 | 80 | 96 | 128 | 160 | 176 | 192 | 224 | 240 | 240 | 240 |
| 144 | 0 | 0 | 16 | 32 | 48 | 64 | 80 | 96 | 112 | 144 | 176 | 192 | 208 | 224 | 240 | 240 |
| 160 | 0 | 0 | 16 | 32 | 48 | 64 | 80 | 96 | 112 | 128 | 160 | 192 | 208 | 224 | 240 | 240 |
| 176 | 0 | 0 | 16 | 32 | 48 | 64 | 80 | 96 | 112 | 128 | 144 | 176 | 208 | 224 | 240 | 240 |
| 192 | 0 | 0 | 16 | 32 | 48 | 64 | 80 | 96 | 112 | 128 | 144 | 160 | 192 | 224 | 240 | 240 |
| 208 | 0 | 0 | 16 | 32 | 48 | 48 | 64 | 80 | 96 | 112 | 128 | 160 | 176 | 208 | 240 | 240 |
| 224 | 0 | 0 | 16 | 32 | 48 | 48 | 64 | 80 | 96 | 112 | 128 | 144 | 176 | 192 | 224 | 240 |
| 240 | 0 | 0 | 0 | 16 | 32 | 48 | 48 | 64 | 80 | 96 | 112 | 128 | 144 | 176 | 208 | 240 |

In the above tables, a left column is a data voltage VDn-1 of the previous frame Fn-1 while an uppermost row is a data voltage VDn of the current frame Fn. Table 1 is a look-up table information in which the most significant bits (i.e., $2^0$, $2^1$, $2^2$ and $2^3$) are expressed by a decimal number format. Table 2 is a look-up table information in which weighting values (i.e., $2^4$ $2^5$, $2^6$ and $2^7$) of the most significant 4 bits are applied to a 8-bit data.

In order to reduce the volume of the look-up table, only the most significant bit MSB is modulated. A high-speed driving apparatus is implemented in such a way as in FIG. 4.

Referring to FIG. 4, the conventional high-speed driving apparatus includes a frame memory 43 connected to a most significant bit bus line 42, and a look-up table 44 commonly connected to output terminals of the most significant bit bus line 42 and the frame memory 43.

The frame memory 43 stores the most significant bit data MSB for a frame period, and supplies the stored data to the look-up table. The most significant bit data MSB herein is set to most significant 4 bits among a source data RGB Data In having 8 bits.

The look-up table 44 compares the most significant bit data MSB of the current frame Fn inputted from the most significant bit bus line 42 with the most significant bit data MSB of the previous frame Fn-1 inputted from the frame memory 43, to select and output the corresponding modulated data Mdata. The modulated most significant bit data is added with least significant bit data LSB from a least significant bit bus line 41 prior to sending to the liquid crystal display.

The high-speed driving method and device, which modulates only 4 bits of the most significant bit data MSB occupies relatively a small volume since the data width of the frame memory 43 and the look-up table is 4 bits. Thus, the value of the modulated data registered at the look-up table 44 is limited only to the possible value in the 4 bits as shown in the table 1 and table 2.

Consequently, as shown in FIG. 5, it deviates at the gray level part, indicated by arrows, between the gray level of the data inputted in real and the gray level of the modulated data. As a result, the brightness is changed as much as the deviated portions. In other words, the modulated data should be set more than 4 bits to implement a natural looking moving picture. Nonetheless, since the data width of the look-up table is limited to 4 bits, the modulated data is set to less than 4 bits. As a result, a brightness difference becomes even bigger when a difference between the real gray levels is small.

SUMMARY OF THE INVENTION

Accordingly, the present invention is directed to a method and apparatus for driving a liquid crystal display that substantially obviates one or more of problems due to limitations and disadvantages of the related art.

Another object of the present invention is to provide a method and apparatus for driving a liquid crystal display that is adaptive for preventing a deterioration in picture quality.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a liquid crystal display includes dividing input data into most significant bit data and least significant bit data, delaying the most significant bit data for one frame period, and modulating the most significant bit data in accordance with a difference between the delayed most significant bit data and the current most significant bit data, wherein the modulated data have a data width not wider than that of the input data and not narrower than that of the most significant bit data.

In another aspect of the present invention, a liquid crystal display includes a liquid crystal display panel displaying images and having a plurality of data lines and a plurality of gate lines thereon, a timing controller rearranging video data received from an input data and outputting RGB data and first and second timing signals, a data modulator modulating most significant bits of the video data based on a look-up table having a data width not wider than that of the input data and not narrower than that of the most significant bits, a data driver receiving the modulated video data and the first timing signal, attaching least significant bits thereto, and supplying the modulated video data to the liquid crystal display panel through the data lines, and a gate driver receiving the second timing signal and supplying a scanning signal to the liquid crystal display panel through the gate lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 1:
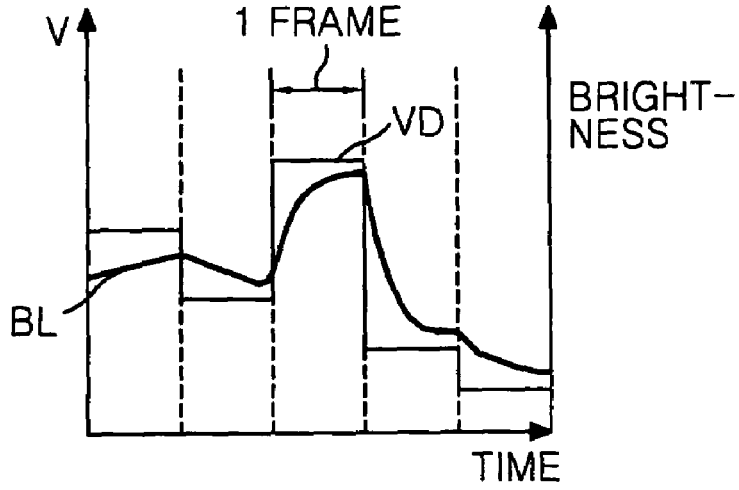
FIG. 1 CONVENTIONAL ART
FIG. 1 is a waveform diagram showing a brightness variation in a data modulation according to a conventional liquid crystal display.
Figure 2:
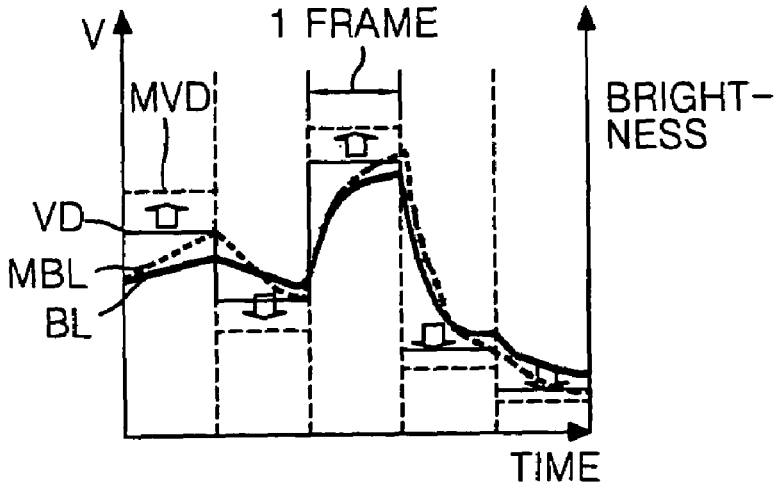
FIG. 2 CONVENTIONAL ART
FIG. 2 is a waveform diagram showing a brightness variation in a data modulation according to a conventional high-speed driving method.
Figure 3:
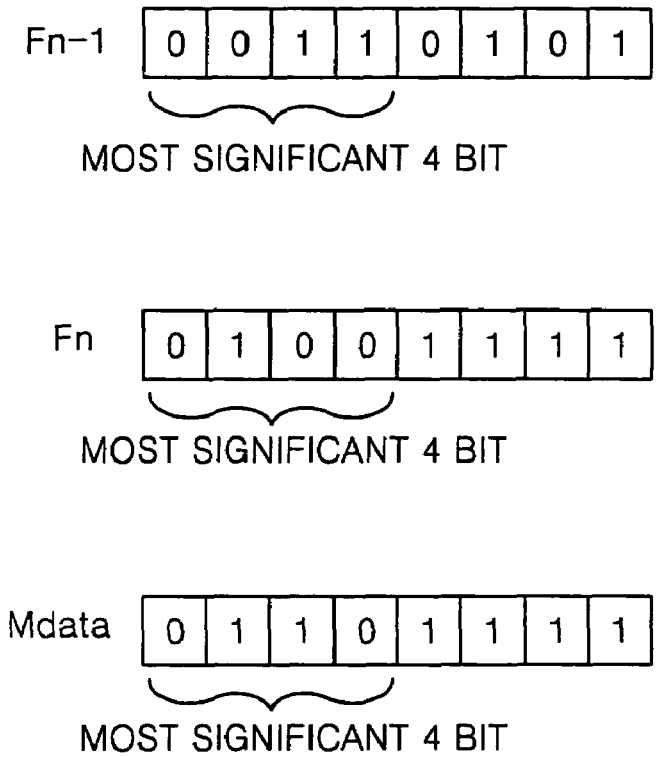
FIG.3 CONVENTIONAL ART
FIG. 3 illustrates the conventional high-speed driving method based on 8 bit data.
Figure 4:
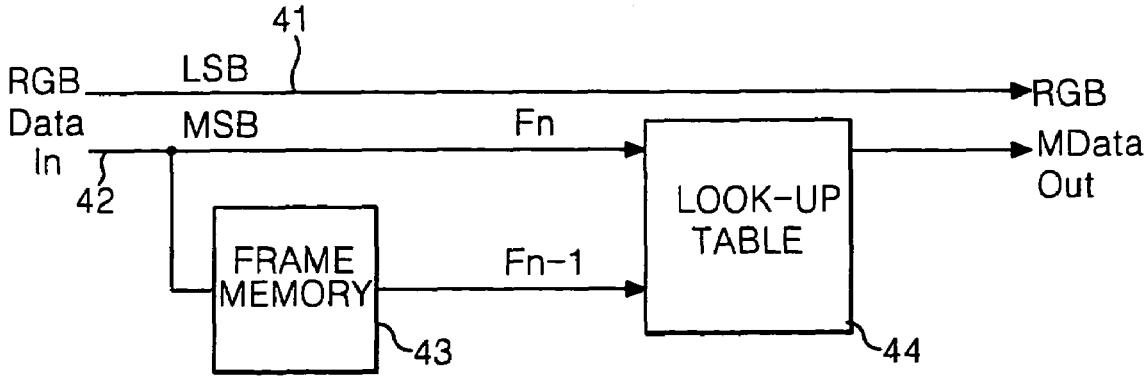
FIG.4 CONVENTIONAL ART
FIG. 4 is a block diagram showing a configuration of a conventional high-speed driving apparatus.
Figure 5:
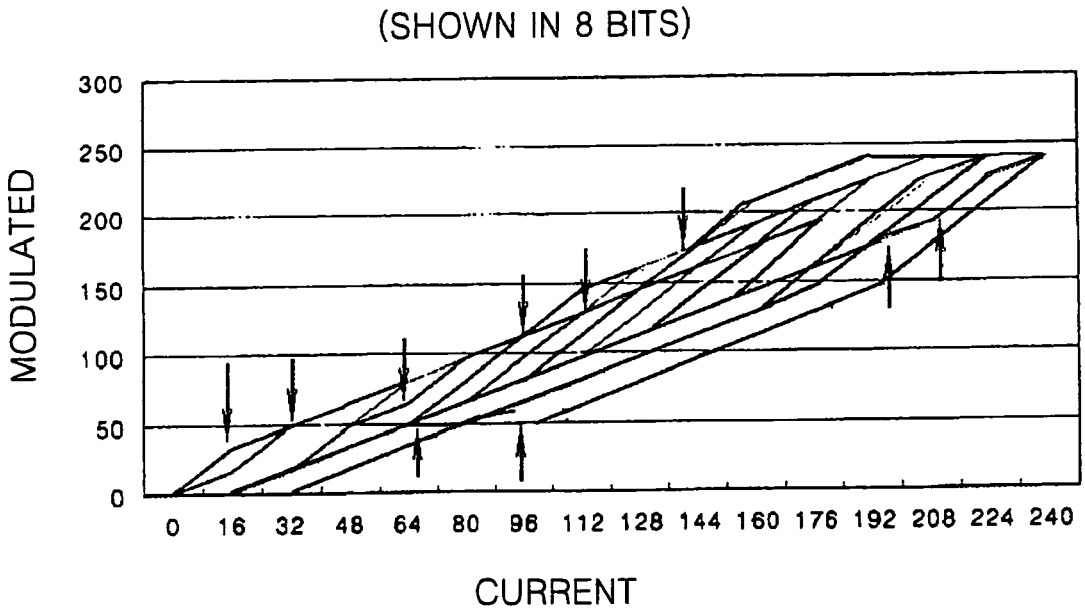
FIG. 5 is a graph showing modulated data based on table 2.
Figure 6:
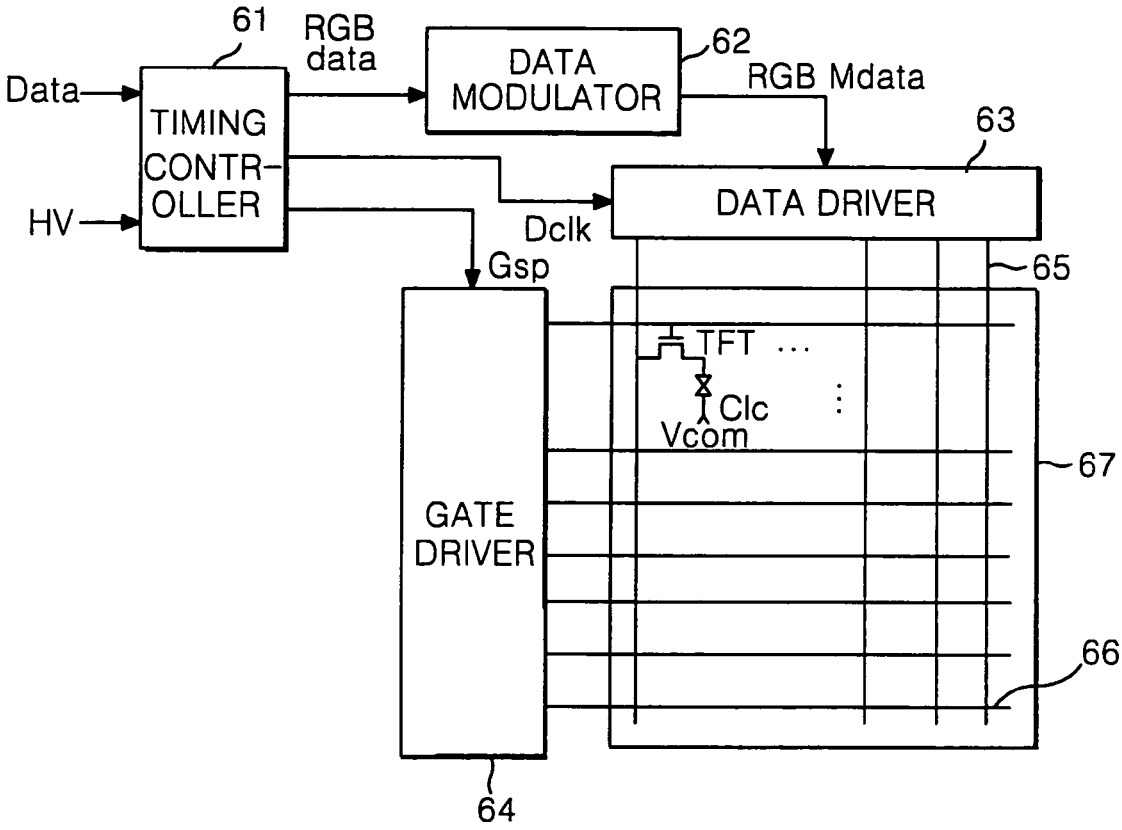
FIG. 6 is a block diagram showing a configuration of a driving apparatus for a liquid crystal display according to the present invention.
Figure 7:
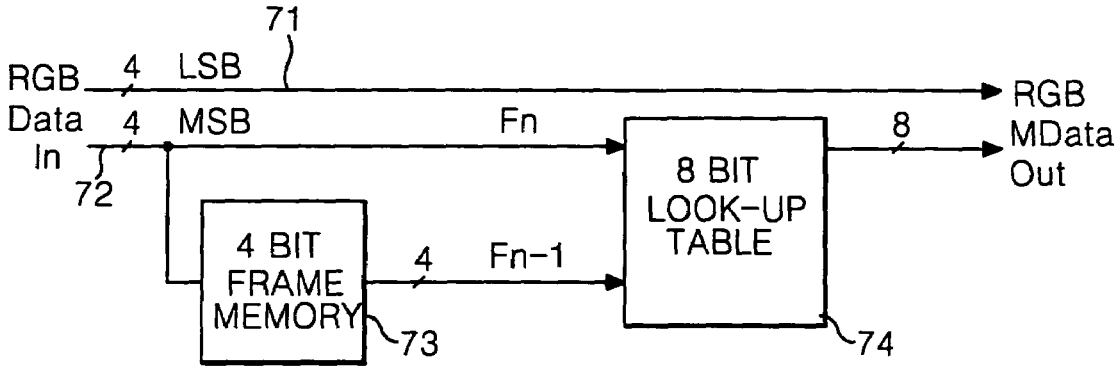
FIG. 7 is a detailed block diagram of a data modulator shown in FIG. 6.
Figure 8:
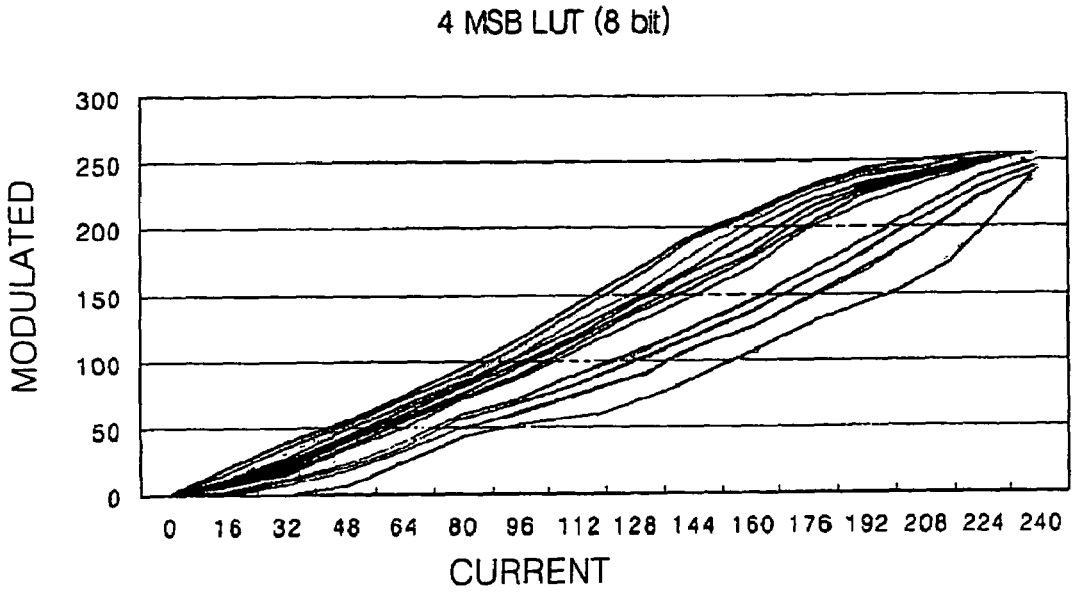
FIG. 8 is a graph showing a modulated data based on table 3.

With reference to FIGS. 6 to 8, the present invention will be described hereinafter.

Initially referring to FIG. 6, an LCD driving apparatus according to the present invention includes a liquid crystal display panel 67 having a plurality of data lines 65 and a plurality of gate lines 66 crossing each other and having a plurality of TFT's provided at the intersections to drive liquid crystal cells Clc. A data driver 63 supplies data to the data lines 65 of the liquid crystal display panel 67. A gate driver 64 applies scanning pulses to the gate lines 66 of the liquid crystal display panel 67. A timing controller 61 receives digital video data and synchronizing signals H and V. A data modulator 62 is connected between the timing controller 61 and the data driver 63 to modulate input data RGB data.

More specifically, the liquid crystal display panel 67 has a liquid crystal positioned between two glass substrates, and has the data lines 65 and the gate lines 66 provided on the lower glass substrate in such a manner to perpendicularly cross each other. The TFT provided at each intersection between the data lines 65 and the gate lines 66 responds to a scanning pulse for supplying data on the data line 65 to the liquid crystal cell Clc. To this end, a gate electrode of the TFT is connected to the gate line 66 while a source electrode thereof is connected to the data line 65. The drain electrode of the TFT is connected to a pixel electrode of the liquid crystal cell Clc.

The timing controller 61 rearranges the digital video data supplied from a digital video card (not shown). The RGB data rearranged by the timing controller 61 is supplied to the data modulator 62. Further, the timing controller 61 creates timing signals, such as a dot clock Dclk, a gate start pulse GSP, a gate shift clock GSC (not shown), an output enable/disable signal, and a polarity control signal using horizontal and vertical synchronizing signals H and V to control the data driver 63 and the gate driver 64. The dot clock Dclk and the polarity control signal are applied to the data driver 63 while the gate start pulse GSP and the gate shift clock GSC are applied to the gate driver 64.

The gate driver 64 includes a shift register sequentially generating a scanning pulse, that is, a gate high pulse in response to the gate start pulse GSP and the gate shift clock GSC supplied from the timing controller 61 and a level shifter shifting a voltage of the scanning pulse into a level suitable for driving the liquid crystal cell Clc. The TFT is turned on in response to the scanning pulse to apply video data on the data line 65 to the pixel electrode of the liquid crystal cell Clc.

The data driver 63 is supplied with red (R), green (G), and blue (B) modulated data RGB Mdata modulated by the data modulator 62 and receives a dot clock Dclk from the timing controller 61. The data driver 63 latches the red (R), green (G), and blue (B) modulated data RGB Mdata in synchronization with the dot clock Dclk and thereafter converts the latched data into analog data to apply the analog data to the data lines 65 line by line. Further, the data driver 63 may apply a gamma voltage corresponding to the modulated data to the data line 65.

The data modulator 62 modulates the inputted current data RGB by using a look-up table based on a difference between a previous frame Fn-1 and a current frame Fn. Further, a data width of the look-up table is set to the extent of less than or equal to that of a source data RGB inputted from the timing controller 61 and greater than or equal to that of most significant bit data MSB.

The data modulator 62 is implemented in FIG. 7.

Referring to FIG. 7, the data modulator 62 according to the present invention includes a 4 bit frame memory 73 receiving 4 bit most significant bit data MSB inputted from a timing controller 61 (shown in FIG. 6) and an 8 bit look-up table modulating the 4 bit most significant bit data MSB to a 8 bit modulated data.

More specifically, the 4 bit frame memory 73 is connected to a most significant bit bus line 72 of the timing controller 61 and stores the most significant bit data MSB inputted from the timing controller 61 for a frame period. The frame memory 73 supplies the 4 bit most significant bit data MSB to the 8 bit look-up table 74 at every frame.

The 8 bit look-up table 74 modulates the most significant bit data MSB of the current frame Fn, as the following equations ① to ③ based on a difference between the 4 bit most significant bit data MSB of the current frame Fn, which is inputted from the most significant bus line 72 of the timing controller 61, and the 4 bit most significant bit data MBS of the previous frame Fn−1, which is inputted from the 4 bit frame memory 73.

$$VDn<VDn\text{-}1 \text{----}> MVDn<VDn \quad ①$$

$$VDn=VDn\text{-}1 \text{----}> MVDn=VDn \quad ②$$

$$VDn>VDn\text{-}1 \text{----}> MVDn>VDn \quad ③$$

In the above equations, VDn-1 represents a data voltage of the previous frame, VDn represents a data voltage of the current frame, and MVDn is a modulated data voltage. The modulated data registered at the look-up table 74 is 8 bits so as to have an expressible value of upto 8 bits, which was not possible in the conventional art, as shown in table 3. Conventionally, only 4 bits data were used in the look-up table.

TABLE 3

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 0 | 0 | 20 | 39 | 55 | 74 | 95 | 116 | 143 | 167 | 194 | 212 | 231 | 245 | 250 | 255 | 255 |
| 16 | 0 | 16 | 36 | 52 | 71 | 90 | 111 | 138 | 162 | 191 | 210 | 230 | 242 | 247 | 255 | 255 |
| 32 | 0 | 13 | 32 | 50 | 68 | 87 | 108 | 135 | 159 | 188 | 207 | 228 | 240 | 246 | 255 | 255 |
| 48 | 0 | 12 | 28 | 48 | 66 | 84 | 105 | 130 | 151 | 180 | 204 | 226 | 239 | 245 | 255 | 255 |
| 64 | 0 | 10 | 26 | 44 | 64 | 82 | 103 | 124 | 146 | 170 | 198 | 220 | 234 | 242 | 252 | 255 |
| 80 | 0 | 8 | 23 | 42 | 60 | 80 | 98 | 119 | 143 | 167 | 186 | 215 | 231 | 240 | 250 | 255 |
| 96 | 0 | 7 | 20 | 39 | 58 | 75 | 96 | 116 | 138 | 159 | 180 | 210 | 228 | 239 | 249 | 255 |
| 112 | 0 | 7 | 18 | 36 | 55 | 73 | 90 | 112 | 135 | 154 | 178 | 202 | 226 | 237 | 249 | 255 |
| 128 | 0 | 6 | 15 | 34 | 50 | 71 | 87 | 108 | 128 | 148 | 170 | 199 | 218 | 234 | 248 | 255 |
| 144 | 0 | 5 | 14 | 31 | 47 | 68 | 84 | 103 | 122 | 144 | 167 | 191 | 212 | 231 | 247 | 255 |
| 160 | 0 | 4 | 13 | 28 | 44 | 66 | 79 | 98 | 119 | 138 | 160 | 183 | 210 | 228 | 244 | 254 |
| 176 | 0 | 3 | 12 | 26 | 42 | 63 | 74 | 95 | 114 | 130 | 151 | 176 | 199 | 223 | 242 | 252 |
| 192 | 0 | 2 | 11 | 23 | 39 | 60 | 72 | 90 | 103 | 124 | 143 | 167 | 192 | 215 | 239 | 250 |
| 208 | 0 | 1 | 10 | 20 | 36 | 58 | 68 | 82 | 98 | 116 | 135 | 159 | 180 | 208 | 231 | 247 |
| 224 | 0 | 0 | 8 | 18 | 33 | 50 | 60 | 74 | 87 | 108 | 124 | 146 | 167 | 194 | 224 | 244 |
| 240 | 0 | 0 | 0 | 7 | 26 | 42 | 52 | 58 | 68 | 87 | 103 | 127 | 143 | 162 | 199 | 240 |

As shown in table 3, because the memory used in the 8 bit look-up table 74 has a data width of 8 bits, it is possible to express the values which were impossible to express with 4 bits in the conventional high-speed driving method. For example, the value above 241 written in the shadowed cells are impossible to express only with 4 bits in the conventional high-speed driving strategy. In the present invention, those values can be set as the modulated data.

FIG. 8 is a graphic view of the modulated data by using table 3. As shown in table 3 and FIG. 8, the data width of the modulated data is not only expanded to expand the modulated data value in the upper gray level, but also coded linearly. Thus, the data value between the gray levels become linear without any deviations.

The 8 bit modulated data coming out of the 8 bit look-up table 74 is added to the least significant bit data LSB of 4 bits originated from the least significant bit bus line 71 of the timing controller 61. Thus, a 8 bit video data modulated by the data modulator 62 is supplied to the data driver 63. In a different way, the least significant bit data LSB is not supplied to the data driver 63 and only the modulated data and an expanded bit are supplied by the look-up table 74.

As shown in table 4, the input/output data width of the look-up table and the frame memory 73 of the data modulator 62 according to the present invention is increased in the look-up table only, thereby reducing the load of the hardware. Thus, the extent of the setting value of the modulated data registered at the look-up table 74 is expanded corresponding to the real gray level value of the input video data in accordance with an increase in the data width of the look-up table.

TABLE 4

| | Conventional Art | Present Invention |
|---|---|---|
| Source Data (RGB Data In) | 8 bit | 8 bit |
| Most Significant Bits (MSB) | 4 bit | 4 bit |

TABLE 4-continued

| | Conventional Art | Present Invention |
|---|---|---|
| Least Significant Bits (LSB) | 4 bit | 4 bit |
| Frame Memory | 4 bit | 4 bit |

TABLE 4-continued

| | Conventional Art | Present Invention |
|---|---|---|
| Look-up Table Memory | 4 bit | 8 bit |
| Output Data (RGB Data Out) | 8 bit | 8 bit |

Meanwhile, the look-up table 74 has a data width the same as the source data (RGB Data In) in the present invention. A data width of the look-up table 74 is determined between the data width of the most significant bit data MSB and the data width of the source data (RGB Data In). Also, as described above, the expanded look-up table is used to implement a bit-expansion to the extent that the data width is less than or equal to the data width of the input data, and to implement a bit-expansion to the data width which is greater than or equal to the data width of the input data.

The data modulator 62 may be implemented by other means, such as a program and a microprocessor for carrying out the program, rather than a look-up table. Further, the data modulator 62 not only modulates the most significant bit data, but also the whole 8 bit source data by making both the data widths of the frame memory and the look-up table as 8 bits.

As described above, according to the present invention, the data width of the look-up table is expanded, so that the values of the modulated data registered at the look-up table are expanded as much as the data width of the look-up table is expanded. Accordingly, a quality of the display screen is improved because the modulated date value is set in correspondence to the real gray level.

It will be apparent to those skilled in the art that various modifications and variations can be made in the method and apparatus for driving liquid crystal display of the present invention without departing from the spirit or scope of the inventions. Thus, it is intended that the present invention covers the modifications and variations of this invention provided they come within the scope of the appended claims and their equivalents.

What is claimed is:

1. A method of driving a liquid crystal display, comprising:

dividing input data into most significant bit data and least significant bit data;

delaying the most significant bit data for one frame period; and generating modulated current most significant bit data in accordance with a difference between the delayed most significant bit data and the current most significant bit data and independently from the least significant bit data, wherein the modulated current most significant bit data contains more data bits than do each of the current most significant bit data and the delayed most significant bit data.

2. The method according to claim 1, wherein the current and delayed most significant bit data and the least significant bit data are each 4 bits wide, and the input data and the modulated current most significant bit data are each 8 bits wide.

3. The method according to claim 1, further comprising:

combining the current least significant bit data and the modulated current most significant bit data to generate an output video data.

4. The method according to claim 3, wherein the liquid crystal display comprises a liquid crystal display panel having a plurality of data lines, the method further comprising:

driving the data lines with the output video data.

5. The method according to claim 1, wherein the generating modulated current most significant bit data comprises, selecting desirable data from a look-up table based on the current most significant bit data and the delayed most significant bit data; and outputting the selected data as the modulated current most significant bit data.

6. The method according to claim 4, wherein the look-up table stores available gray level values of the modulated current most significant bit data based on the available gray level values of the current most significant bit data and the available gray level values of the delayed most significant bit data.

7. A driving apparatus for a liquid crystal display, comprising:

a memory to receive most significant bits of data for an $n^{th}$ frame from an input line and to output the most significant bits of data for an $(n-1)^{th}$ frame; and a modulator to modulate the most significant bits of data, the data including most significant bits of data and least significant bits of data of the $n^{th}$ frame in accordance with a difference between the most significant bits of data for the $(n-1)^{th}$ frame and the most significant bits of data for the $n^{th}$ frame and independently of the least significant bits of data, wherein the modulated most significant bits of data contain more data bits than do each of the most significant bits data and the $(n-1)^{th}$ frame and the most significant bits of data for the $n^{th}$ frame.

8. The apparatus according to claim 7, wherein the most significant bits of data and least significant bits of data from the input line are each 4 bits wide, and the input data and the modulated most significant bits of data are each 8 bits wide.

9. The apparatus according to claim 7, wherein the modulator includes a look-up table having available gray level values for the modulated most significant bits of data.

10. The apparatus according to claim 9, wherein the look-up table stores available gray level values of the modulated most significant bits of data based on the available gray level values of the most significant bits of data for the $(n-1)^{th}$ frame and the available gray level values of the most significant bits of data for the $n^{th}$ frame.

11. The apparatus according to claim 7, further comprising:

a liquid crystal display panel having a plurality of data lines and a plurality of gate lines;

a data driver to combine the modulated most significant bits of data from the modulator and the least significant bits of data bypassed from the input line to generate a modulated video data, and to supply the modulated video data to the data lines;

a gate driver to supply supplying the scanning signals to the gate lines; and a timing controller to supply video data to the input line and to concurrently control the data driving and the gate driver.

12. A liquid crystal display comprising:

a liquid crystal display panel having a plurality of data lines and a plurality of gate lines thereon;

a timing controller to rearrange video data received from an input data and outputting RGB data including most significant bits of the RGB data and least significant bits of the RGB data and first and second timing signals;

a data modulator to modulate the most significant bits of the RGB data based on a look-up table storing modulated most significant bits of the RGB data, wherein the modulated most significant bits of the RGB data contain more data bits than do the most significant bits of the RGB data and wherein the least significant bits of the RGB data bypass the modulator;

a data driver to receive the first timing signal, and to combine the modulated most significant bits of the RGB data and the least significant bits of the RGB data, which bypassed the data modulator, to generate a modulated video data, the data driver supplying the modulated video data to the liquid crystal display panel through the data lines; and a gate driver to receive the second timing signal and to supply a scanning signal to the liquid crystal display panel through the gate lines.

13. The liquid crystal display according to claim 12, wherein the data modulator includes;

a frame memory delaying current most significant bits of the RGB data for one frame period and outputting the delayed most significant bits of the RGB data, and a look-up table receiving both the current most significant bits of the RGB data and the delayed most significant bits of the RGB data and outputting the modulated most significant bits of the RGB data.

14. The apparatus according to claim 13, wherein the look-up table stores available gray level values of the modulated most significant bits of the RGB data based on the available gray level values of the current most significant bits of the RGB data and the available gray level values of the delayed most significant bits of the RGB data.

15. The liquid crystal display according to claim 12, wherein the most significant bits of the RGB data and the least significant bits of the RGB data are each 4 bits wide, and the RGB data and the modulated most significant bits of the RGB data are each 8 bits wide.

* * * * *